US007549701B2

(12) United States Patent
Erker

(10) Patent No.: US 7,549,701 B2
(45) Date of Patent: Jun. 23, 2009

(54) SEATBACK ADJUSTMENT

(75) Inventor: Christian Erker, Usingen (DE)

(73) Assignee: Sato-Office GmbH (DE)

( * ) Notice: Subject to any disclaimer, the term of this patent is extended or adjusted under 35 U.S.C. 154(b) by 163 days.

(21) Appl. No.: 10/581,382

(22) PCT Filed: Dec. 2, 2004

(86) PCT No.: PCT/DE2004/002649

§ 371 (c)(1),
(2), (4) Date: Feb. 28, 2007

(87) PCT Pub. No.: WO2005/053461

PCT Pub. Date: Jun. 16, 2005

(65) Prior Publication Data

US 2007/0170762 A1 Jul. 26, 2007

(30) Foreign Application Priority Data

Dec. 2, 2003 (DE) ..... 103 56 190

(51) Int. Cl.
*B60N 2/02* (2006.01)

(52) U.S. Cl. ..... 297/309; 297/299

(58) Field of Classification Search ..... 297/217.3, 297/301.1, 309, 285, 299, 302.1, 302.5, 302.6, 297/300.1, 217.2, 301.5, 301.6
See application file for complete search history.

(56) References Cited

U.S. PATENT DOCUMENTS

| | | | | |
|---|---|---|---|---|
| 2,587,822 | A * | 3/1952 | Corning | 403/220 |
| 4,640,548 | A * | 2/1987 | Desanta | 297/300.3 |
| 4,830,432 | A | 5/1989 | Fuhrmann et al. | |
| 5,547,252 | A | 8/1996 | Pfenniger et al. | |
| 6,116,687 | A * | 9/2000 | Vogtherr | 297/300.1 |
| 6,520,023 | B2 * | 2/2003 | Kimura | 73/795 |

FOREIGN PATENT DOCUMENTS

| | | | |
|---|---|---|---|
| DE | 199 31 099 | A1 | 2/2001 |
| EP | 0 434 897 | A | 7/1991 |
| EP | 0 435 297 | A | 7/1991 |
| EP | 1 342 432 | A | 9/2003 |
| EP | 1 358 821 | A | 11/2003 |
| JP | 02 071347 | U | 5/1990 |

OTHER PUBLICATIONS

International Search Report PCT/EP2004/002649 dated Apr. 21, 2005.

* cited by examiner

*Primary Examiner*—Milton Nelson, Jr.
(74) *Attorney, Agent, or Firm*—Ostrolenk, Faber, Gerb & Soffen, LLP

(57) ABSTRACT

The invention concerns an arrangement for adjusting the seat back inclination of a seat into an optimum individual inclination position without manipulation or motor aids, which is characterised in that it comprises a sensor system for ascertaining the weight of the user of the seat and transfer of the result to a resilient element by way of which the sensor system result is transmitted to the seat back limbs.

11 Claims, 3 Drawing Sheets

B
1
2
3
4
5
6,20
7
9
10
11
12
13
16
17
22
24
C
D

B
1
2a
3
4
5
6,20
7
9a
10
11
12
13
15
17
18
22
24
26
28
30
A
D

SEATBACK ADJUSTMENT

CROSS REFERENCE TO RELATED APPLICATIONS

The present application is a 35 U.S.C. §371 National Phase conversion of PCT/DE2004/002649 filed Dec. 2, 2004, which claims priority of German Application No. 103 56 190.0 filed Dec. 2, 2003. The PCT application was published in the German language.

FIELD OF THE INVENTION

The invention concerns an arrangement for adjusting the seat back inclination of a seat which is characterised in that it functions without manual or motor assistance. Adjustment of the seat back inclination is effected individually in dependence on the weight of the user of the seat without the user of the seat having to employ any lever or a motor function.

The basis of the invention is ascertaining the loading due to the effect of the weight of the user of the seat on the seat surface B and sensor detection of the seat loading by means of a sensor system A in the form of length mass distance detection and transfer of the length distance movement resulting due to the seat loading by means of a transfer means C to a resilient element D. The resilient element comprises a reversibly compressible and re-expandable flexible material which is compressed to a greater or lesser degree relative to the length distance movement detected by sensor means in regard to the force acting on the seat with the loading thereon.

The resilient element is located between at least two clamping jaws or clamping surfaces 14. In accordance with the travel distance which is detected by the sensor system and transferred by the transfer means to the resilient element, the resilient element is compressed to a greater or lesser degree and the components connected to the seat back are spread to a greater or lesser degree, which is expressed directly as an angular inclination of the seat back of a seat.

BACKGROUND OF THE INVENTION

The motion dynamics of seats, in relation to a seat back which is possibly coupled to the seat squab, in dependence on the weight of the person using the seat, requires a suitably adjusted stressing force configuration for spring systems in order to urge the seat with the body weight into position, or for return to another position, for example into the vertical position. The problems involved with manual adjustment of the seat back inclination setting, usually by means of overcoming a spring stressing force, are often laborious and arduous. In the motor vehicle sector for example the seat inclination setting is often manipulated while a vehicle is travelling, which distracts the driver in terms of vehicle control and can therefore possibly cause an accident. In the case of spring stressing force systems which are coupled to the seat and the back, light or dainty, non-muscular persons can scarcely manipulate such a system because they cannot push the seat back backwards. Heavy muscular types on the other hand have the feeling of drifting off rearwardly when they wish to change the inclination of the seat back rearwardly.

Mechanical systems of adjusting mechanisms for adjusting or changing the position of the backs of seats, on a manual or motor basis, are sufficiently known and are state of the art. Such systems must always be individually adjusted in dependence on the individual stature of the user. An optimum individual and body-related seat back positioning and arresting can be implemented only with difficulty, if at all. If the seat back setting is not correct, the user, for example when using a motor vehicle seat, perceives the occurrence of back complaints and a certain tiredness only after a journey which has lasted a relatively long time. Even moving the back of the seat into a position which is only different but again not correct and securing it in that position provides at best an only temporary remedy because that corrected setting for the seat back is almost always not the right one.

The motion dynamics between the user of a seat with a seat back must always be in conformity temporarily and permanently and therefore must be resolved satisfactorily from the body-physiological point of view.

SUMMARY OF THE INVENTION

Therefore the object of the invention is to develop an adjusting arrangement for seat back inclination adjustment of a seat such that an optimum position of the seat back inclination is always afforded, irrespective of the physical constitution of the user in respect of the weight and the muscular fitness condition thereof.

In addition the invention seeks to provide that the seat user enjoys a non-fatiguing seat comfort and that the seat back adjustment should be self-adjusting, that is to say without the aid of manipulatable or motor assistance.

The object of the invention is attained in accordance with the recitals in claim 1.

The basis of the invention and the primary sensor for attaining the object of the invention is detection of the weight of the user of the seat. The detected weight value is detected by sensor means as a travel distance and transferred by means of a transfer system, for example in the form of a distance direction converter and a thrust rod, to a resilient element which is positioned between at least two clamping jaws or clamping plates or the combinations thereof, by way of which setting of the seat back inclination is effected directly by way of legs connected to the clamping jaws or also by means of combined systems where a limb represents the seat back and the counterpart can be a shaped seat portion. In addition the weight sensing means can be implemented pneumatically or hydraulically and transferred to the spring element.

The detected weight as a sensor basic characteristic value for motion dynamic adjustment acts as a travel distance automatically on the following elements and automatically provides that the arrangement according to the invention functions without any foreign action in terms of energy, or manipulation aid.

BRIEF DESCRIPTION OF THE FIGURES

The invention is described hereinafter with reference to following FIGS. 1 through 5.

The further Figure views show the arrangement according to the invention by way of example.

Figure 1:
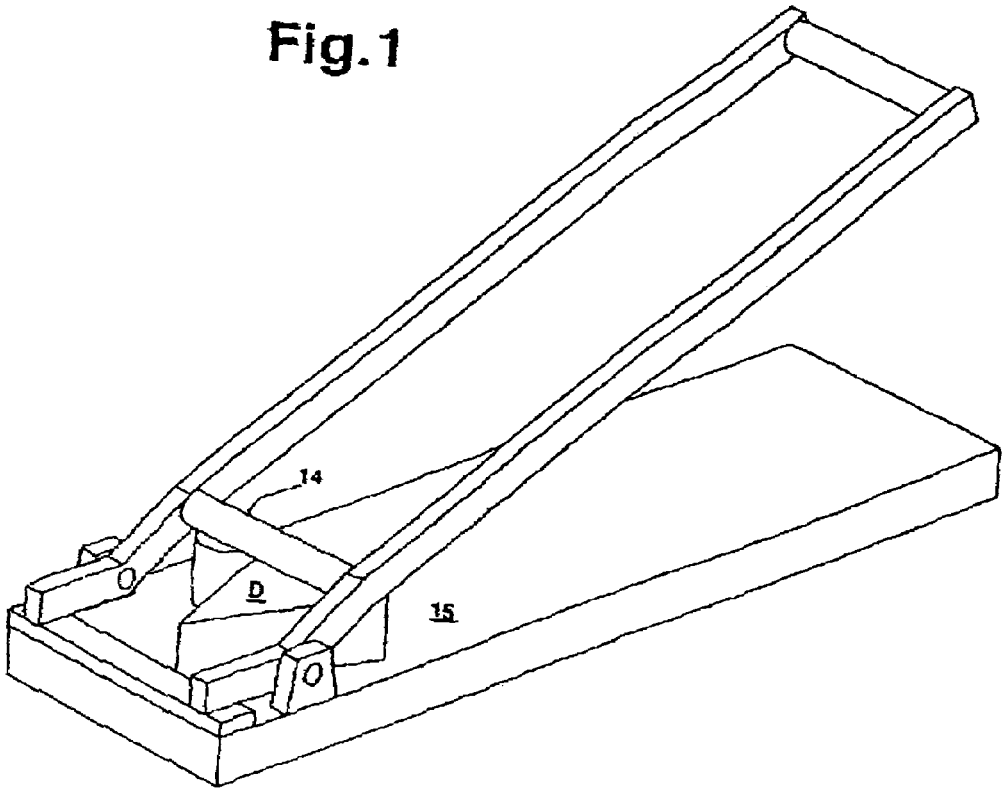
FIG. 1 shows the basic principle of the arrangement according to the invention with the resilient element D in the position as in the case of a heavily loaded seat 1, with clamping jaws 14 and in a configuration with a limb 15, in the dual function as a simultaneous clamping portion. E is the clamping gap between the clamping jaw 14 and in that case the limb 15.
Figure 2:
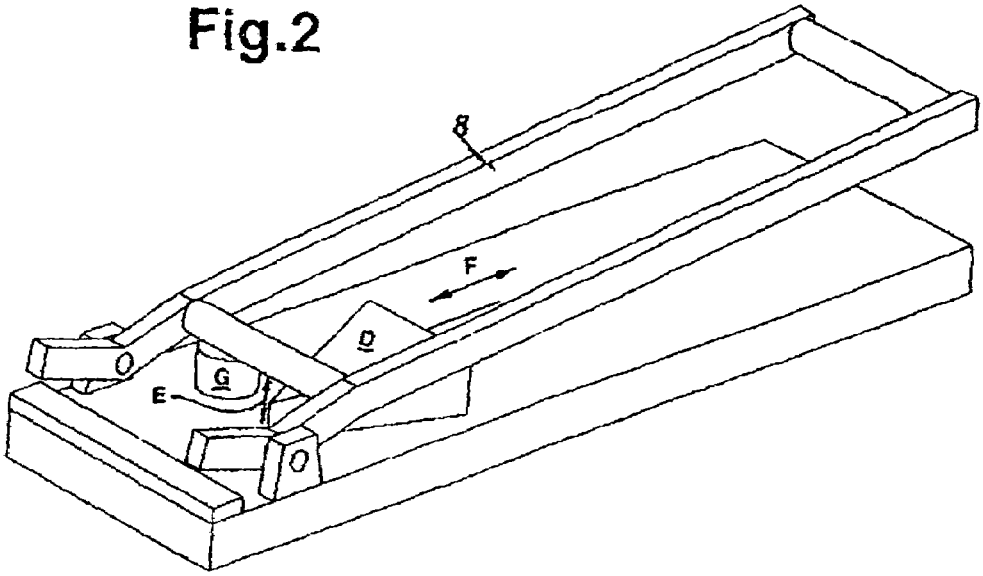
FIG. 2 shows the principle as in FIG. 1 but with the resilient element D in the position with the least seat loading, the spring element is heavily compressed in that position.
Figure 3:
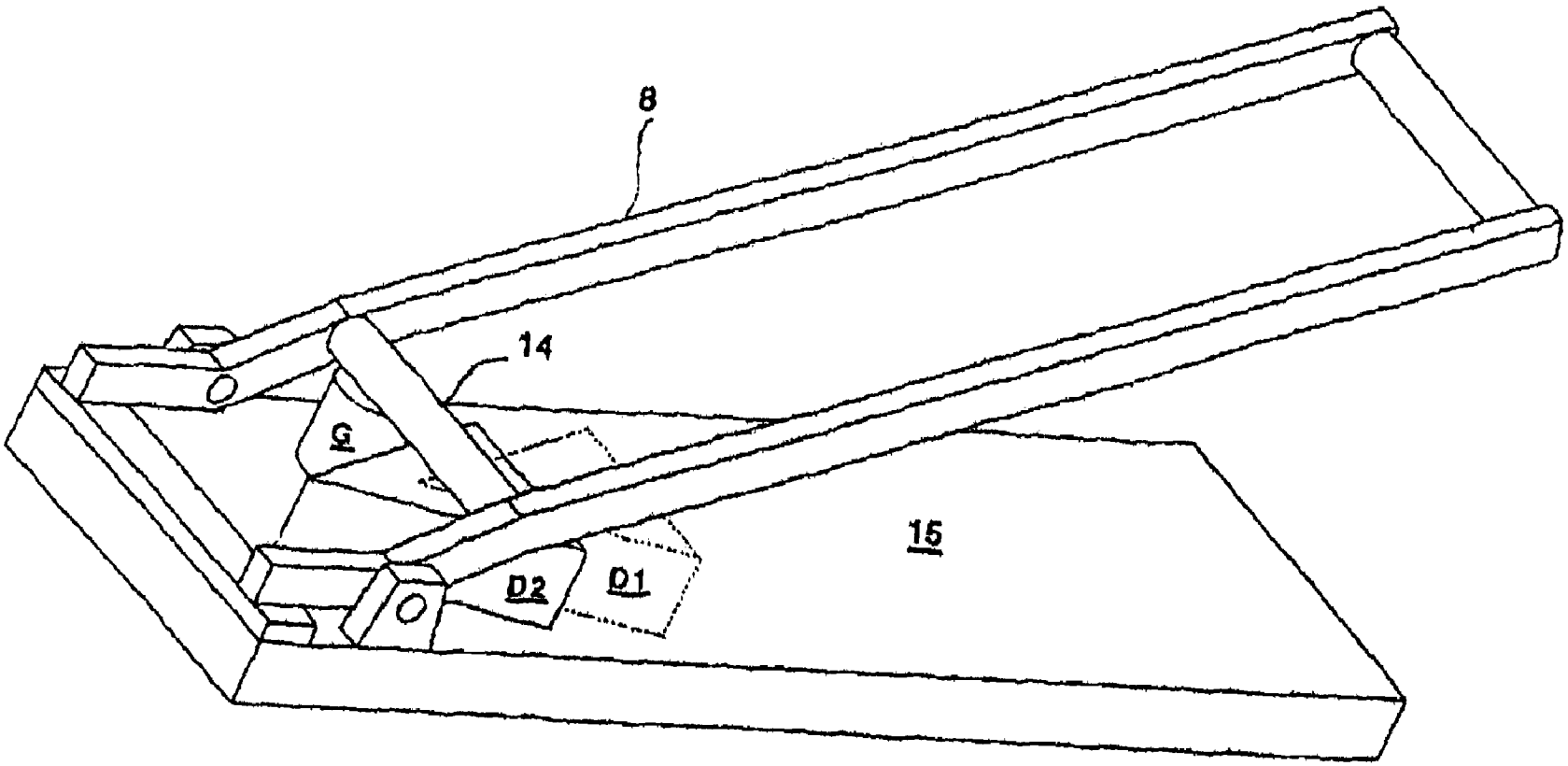
FIG. 3 shows the two views of the resilient element D with the corresponding loadings B with a slight loading—broken-line position of the element D1—and with a heavy loading—continuous line—of the element D corresponding to the travel distances which are detected by the sensor system A and which transferred by means of C on to the resilient element, by way of the clamping jaws 14, implement seat back inclination.
Figure 4:
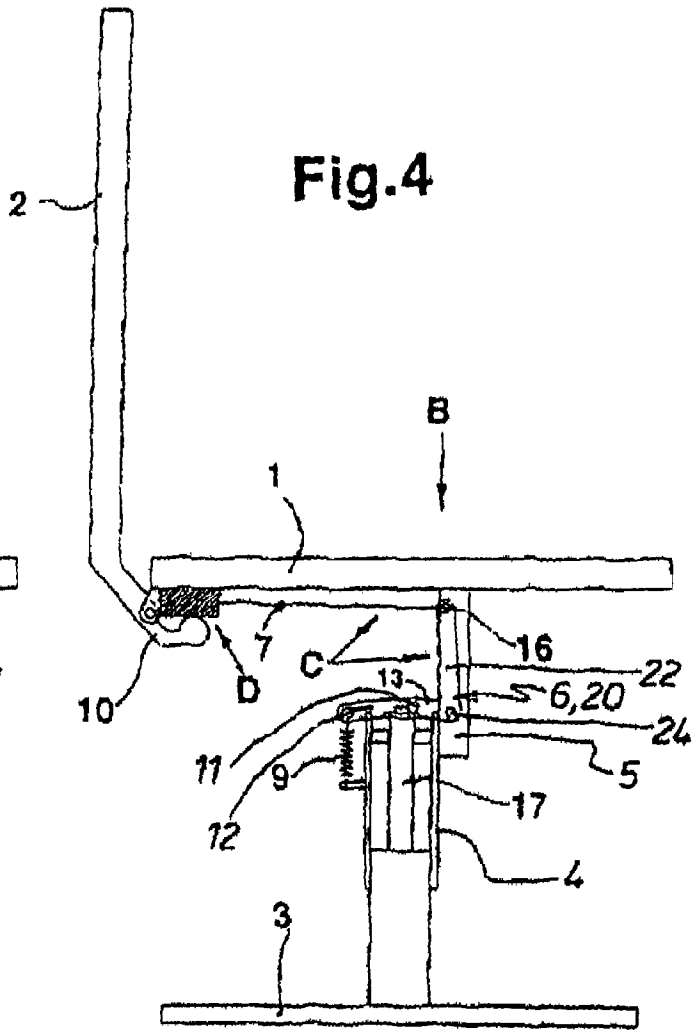

FIG. 4 shows a chair with a seat and the structural variant according to the invention as a side view in the neutral rest position, with the seat 1, the seat back 2, the seat base 3, the support shaft 4, the seat carrier 5, the lower seat back limb 10, the thrust rod 7, the resilient element D, the sensor system C with the weighing spring 9 and the rocker limb 13 disposed at the end of the weighing bar 12. In addition the connecting shaft or axis of 6 and 7 and the fixing support 17.

Figure 5:
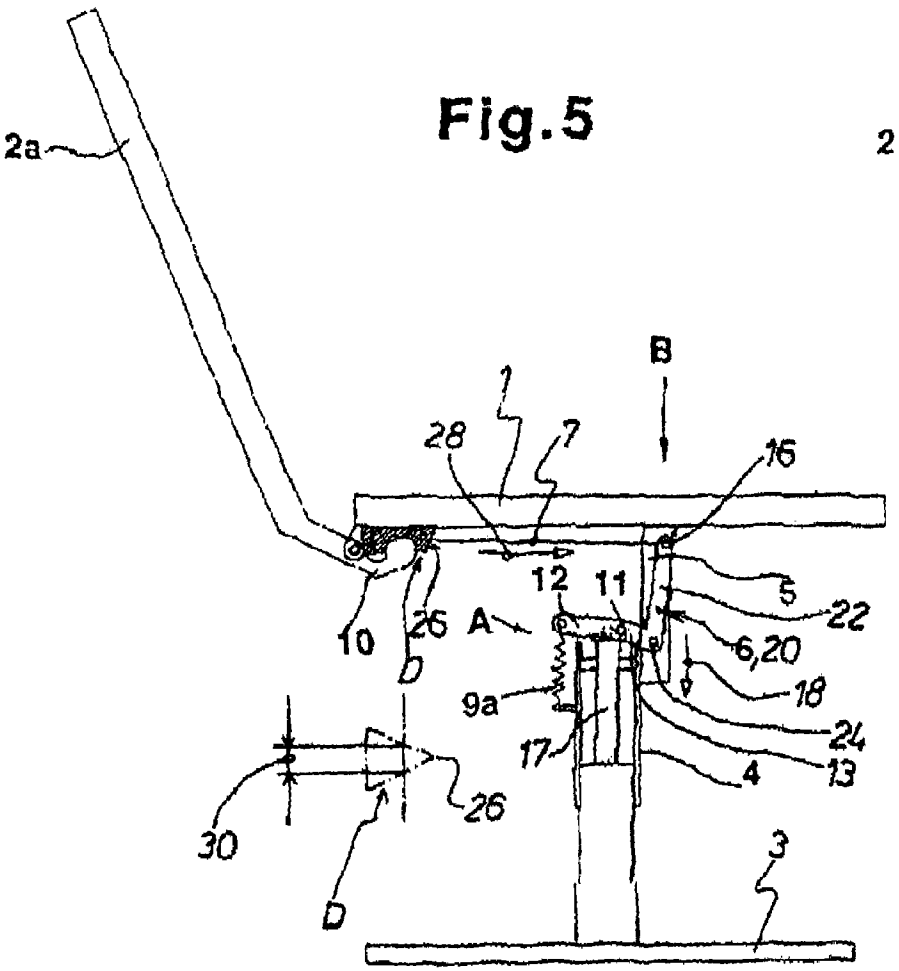

FIG. 5 shows the structure of a chair in operation, with a seat loading B. By way of the rocker shaft 11 fixed on the seat carrier 5 and the rocker limb 13 disposed at the end of the weighing bar 12, the force B acting on the seat due to the user is transmitted by way of the distance direction converter 6 to the horizontal connecting thrust bar 7 taken together as the transfer means C, and to the resilient element D. The weighing result which is distance-related but not ascertained in terms of numerical value is transmitted by way of the resilient element to the lower seat back limb 10, whereby the seat back assumes an angular inclination corresponding to the seat loading B. In that case for example as is shown in 2*a*.

So that the resilient element can move freely in the neutral position in the gap E, a minimum spring force must be applied by a resilient support element G, which is situated with a prestressing beside the resilient element and which prevents the resilient element from prematurely coming into operation.

The resilient element is in the compressed form a kind of energy storage means. The form thereof is not fixed at the wedge shape as depicted, but it can be of different geometrical design configurations.

The present arrangement according to the invention leads to simplified adjustment of the seat backs in conformity with the motion dynamics of the seat user. That involves a reduced expenditure on material for production of the arrangement, in comparison with the state of the art. In particular because any manipulation mechanisms are eliminated, like also possible motors together with batteries or power feed lines, and inclusive of the omission of functional disturbances which occur in relation thereto, with servicing complication and expenditure.

The arrangement for adjusting the seat back inclination, by the term 'self-adjusting', most correctly reproduces the subject-matter of the invention.

The Figures by way of example are representative. Pneumatic or hydraulic length distance detection for the purposes of transfer thereof to the resilient element is effected for example by means of hermetically closed air or fluid cushions, wherein by way of the media pressure and transfer lines, the required stroke distance takes place for reciprocating movement of the resilient element, by way of suitable piston mechanisms.

DETAILED DESCRIPTION OF CERTAIN EMBODIMENTS OF THE INVENTION

The mode of operation of the seat back adjustment according to the invention will now be described with reference to FIGS. 4 and 5.

When a seat user assumes a position on the seat 1, the seat carrier 5 performs a linear movement downwardly along the support shaft 4. That linear movement of the seat carrier 5 in relation to the support shaft 4 is illustrated by the arrow 18 in FIG. 5.

The direction converter 6 has a double-arm angle lever 20 with a weighing bar 12 and a connecting bar 22. The weighing lever 20 is pivotably movably connected in the elbow region by means of a connecting shaft 24 to the seat carrier 5 which is directed downwardly from the seat 1.

The weighing bar 12 is for example linearly horizontally movably mounted with the rocker shaft 11 to the fixing support 17, that is to say the weighing bar 12 is pivotable about the rocker shaft 11, wherein upon a pivotal movement the rocker shaft 11 performs a corresponding horizontal linear movement.

The rocker limb 13 of the direction converter is defined between the rocker shaft 11 and the connecting shaft 24.

Linearly movably arranged at the underside of the seat 1 is the resilient element D which is designed for example with a wedge-shaped base surface. The pointed edge of the resilient element D of triangular configuration in plan is identified by reference numeral 26. In FIG. 5 the resilient element D is shown in dash-dotted lines viewing in the direction of the arrow 28, that is to say viewing in a direction from below.

The resilient element D is connected by means of the connecting thrust bar 7 to the angle lever 20 of the direction converter, that is to say it is connected with its end remote from the resilient element 26 to the connecting shaft 16.

When the seat 10 is loaded by a user of the seat therefore the connecting shaft 24 performs a movement in the clockwise direction about the rocker shaft 11. In that case, the connecting shaft 16 performs a corresponding movement in the clockwise direction about the rocker shaft 11 so that the connecting thrust bar 7 performs a movement in the direction of the arrow 28. The resilient element D is therefore moved in the direction of the arrow 28. That movement of the resilient element D is correspondingly greater, that is to say longer, the greater the weight of the seat user in position on the seat 1. That means however that the spring hardness of the resilient element D, which becomes operative against the component 10 of the seat back 2, increases as a consequence of the increasing width 30 of the contact between the component 10 and the resilient element D, with an increasing loading on the seat 1.

At the same time the weighing spring 9 is stressed when the seat 1 is loaded. When the load on the seat 1 is relieved again, that is to say a seat user leaves the seat 1, the weighing spring 9 is relieved of stress and the resilient element D returns to its non-loaded starting position.

The same details are identified in FIGS. 4 and 5 by the same references.

What is claimed is:

1. An arrangement for adjusting a seat back inclination of a seat comprising (a) a sensor system (A) for ascertaining a length change upon loading of a seat surface (B) between a zero value with a non-loaded seat and a maximum value with seat loading by a very heavy person, with corresponding intermediate values in dependence on an individual weight of a respective user of the seat;

(b) a transfer device (C) operable for transmitting the respectively ascertained length change;

(c) a resilient element (D) to which the ascertained length change is transmitted, the resilient element is reversibly variable so that its compressibility and expandability transmits the transmitted length change, and the resilient element (D) is an elastically yielding volume body;

(d) two counterpart elements between which the resilient element is provided, and the counterpart elements are connected to components which represent the seat back inclination, and (e) a resilient support element (G) for safeguarding free mobility of the resilient element (D) during the zero value loading as a prestressing, wherein the two counterpart elements define between them a clamping gap (E) for the volume body (D), wherein the volume body (D) is partially engaged and compressed by the counterpart elements and in dependence on the ascertained length change of a surface of the volume body (D), which is to be compressed, and thus a volume of the volume body is reduced or increased.

2. The arrangement of claim 1 wherein the volume body (D) is partially engaged and compressed by the two counterpart elements and in dependence on the length change of an elastomer material of differing density disposed in the region of the volume body (D), clamping jaws engaging the volume body (D).

3. The arrangement of claim 2 wherein the volume body (D) has a wedge-shaped configuration.

4. The arrangement of claim 2 wherein the volume body (D) has a flat configuration with a wedge-shaped base surface.

5. The arrangement of claim 2 wherein the volume body (D) comprises closed-cell polyurethane integral foam.

6. The arrangement of claim 1 wherein the volume body (D) has a wedge-shaped configuration.

7. The arrangement of claim 6 wherein the volume body (D) comprises closed-cell polyurethane integral foam.

8. The arrangement of claim 6 wherein the volume body (D) has a flat configuration with a wedge-shaped base surface.

9. The arrangement of claim 1 wherein the volume body (D) has a flat configuration with a wedge-shaped base surface.

10. The arrangement of claim 9 wherein the volume body (D) comprises closed-cell polyurethane integral foam.

11. The arrangement of claim 1 wherein the volume body (D) comprises closed-cell polyurethane integral foam.

* * * * *